US005971530A

United States Patent [19]

Hashimoto

[11] Patent Number: 5,971,530

[45] Date of Patent: Oct. 26, 1999

[54] REFILLABLE, EVAPORATION-SUPPRESSING LIQUID CONTAINER

[75] Inventor: Kenichiro Hashimoto, Yokohama, Japan

[73] Assignee: Canon Kabushiki Kaisha, Tokyo, Japan

[21] Appl. No.: 08/779,425

[22] Filed: Jan. 7, 1997

Related U.S. Application Data

[63] Continuation of application No. 08/323,860, Oct. 17, 1994, abandoned.

[30] Foreign Application Priority Data

Oct. 27, 1993 [JP] Japan ..... 5-268636
Nov. 10, 1993 [JP] Japan ..... 5-280954

[51] Int. Cl.[6] ..... B41J 2/175

[52] U.S. Cl. ..... 347/86; 347/87; 347/94

[58] Field of Search ..... 347/86, 87, 94

[56] References Cited

U.S. PATENT DOCUMENTS 5,021,809 6/1991 Abe et al. ..... 347/94
5,070,347 12/1991 Yuki et al. ..... 347/86
5,113,199 5/1992 Chan et al. ..... 347/87
5,156,472 10/1992 Suzuki et al. ..... 347/86
5,182,581 1/1993 Kashimura et al. ..... 346/140 R
5,216,450 6/1993 Koitabashi et al. ..... 346/140 R
5,365,262 11/1994 Hattori et al. ..... 347/87
5,430,471 7/1995 Nakajimo et al. ..... 347/87

FOREIGN PATENT DOCUMENTS 542247 5/1993 European Pat. Off. ..... 347/87
000514 1/1990 Japan ..... 347/87
201020 8/1993 Japan ..... 347/87

*Primary Examiner*—Valerie Lund
*Assistant Examiner*—Christina Annick
*Attorney, Agent, or Firm*—Fitzpatrick, Cella, Harper & Scinto

[57] ABSTRACT

An ink container, such as that used in an ink jet recording apparatus, is improved to effectively suppress permeation of ambient air into ink compartments through the container walls and to permit easy refilling with ink. The ink container includes a container body which has a plurality of liquid compartments defined therein by a plurality of partition plates to accommodate the ink, and inter-compartment communicating portions through which adjacent ink compartments communicate with each other, so that successive liquid compartments are emptied one after another as the liquid is progressively consumed. The container body also has a buffer compartment which covers at least the top walls of said liquid compartments. The ink container may have a discrete segments of a porous member which are disposed only in the inter-compartment communicating portions.

10 Claims, 9 Drawing Sheets

REFILLABLE, EVAPORATION-SUPPRESSING LIQUID CONTAINER

This application is a continuation of application No. 08/323,860 filed Oct. 17, 1994 now abandoned.

BACKGROUND OF THE INVENTION

FIELD OF THE INVENTION

The present invention relates to a liquid container for a liquid, particularly ink, used in a recording apparatus such as an ink jet recording apparatus, a copying machine or a facsimile apparatus. More particularly, the present invention is concerned with a liquid container which suppressES evaporation of the liquid.

DESCRIPTION OF THE RELATED ART

In the following, ink containers are specifically described by way of example, because the liquid container of the invention is particularly suitable for use as an ink container. It is to be noted, however, that the container of the present invention can also be used for other kinds of liquid.

In general, an ink jet recording apparatus has a recording head from which an ink droplet is discharged. In order to ensure that the ink droplet is stably discharged and to prevent leakage of ink from the head when the recording operation is not being conducted, it is preferred that the ink pressure be maintained at a level slightly below the ambient pressure in the region near the discharge opening of the head. This has been conventionally realized typically by having the level of the ink in an ink container below the level of the recording head so that a slight negative pressure acts on the ink in the region near the discharge opening. However, this kind of ink jet recording apparatus must be used in a predetermined orientation, because its operation relies upon the force of gravity.

In recent years there has been a trend towards miniaturized and portable ink jet recorders. This has given a rise to a construction in which the ink container is carried by a carriage which also carries the recording head, in contrast to known stationary-type ink jet recording apparatuses in which the ink container is mounted separately from the carriage.

To that end, an ink container has been proposed which can apply a suitable level of negative pressure to the ink in the ink container so as to prevent the ink from spilling or leaking when the recording apparatus is not operating.

FIG. 1 is a partially broken-away schematic perspective view of an example of such an ink container, taken from U.S. Pat. No. 5,430,471 while FIG. 2 is a schematic sectional view of the ink container. In these figures, the ink container 101 is shown as being connected with a recording head 105 from which discrete ink droplets fly towards a recording medium such as a sheet of paper to perform recording.

The ink container 101 includes a container body with a bottom wall 101*a* on which is laid a porous member 103 made of a porous material such as sponge. The space inside the container 101 other than the space occupied by the porous member 103 is divided into six compartments by means of partition plates 102*a*, 102*b*, 102*c*, 102*d* and 102*e*. The recording head 105 is attached to the external surface of a front wall 101*b* of the container 101. A vent hole 104 formed in a rear wall 101*c* of the container 101 provides communication between the interior of the container and the ambient air. More specifically, the portion of the rear wall 101*c* defining the vent hole 104 comprises a tube protruding into the container 101 so that the vent hole 104 opens substantially in the center of the compartment adjacent to the rear wall 101*c*. Therefore, ink leakage through the vent hole 104 is prevented regardless of the orientation of the ink container, even when there is ink in the compartment with the vent hole 104, provided that the volume of the ink is no greater than half the volume of this compartment.

A description will now be given of the operation of this ink container during a recording operation of the ink jet recording apparatus, with specific reference to FIGS. 3(*a*) to 3(*c*). It is necessary that the ink container, when used, is oriented such that at least a portion of the porous member 103 is located at the lowermost portion of the ink container as shown, for example, in FIG. 3(*a*). In the initial state, all the compartments except for the compartment in which the vent hole 104 opens are filled with ink. The ink is consumed as the recording operation is continued, so that compartments are successively emptied, starting from the compartment which is most remote from the discharge opening 105*a*. More specifically, the ink is discharged from the discharge opening 105*a* comes from the discharge opening 105*a* is sucked from the compartment which is closest to the discharge opening 105*a*, that is, the sixth compartment as counted from the compartment in which the vent hole 104 opens. Since the sixth compartment is connected to the fifth compartment only through the porous member 103, the same amount of ink as that discharged from the discharge opening is supplied to the sixth compartment from the fifth compartment through the minute passages in the porous member 103. Likewise, transfer of ink takes place between successive compartments, from a compartment closer to the vent hole 104 to the adjacent compartment closer to the discharge opening, so that the discharge opening is continuously supplied with ink. When a compartment is emptied, air is supplied from that compartment into the adjacent compartment closer to the discharge opening 105*a* through the porous member 103. Consequently, the compartments are successively emptied starting from the compartment closest to the vent hole 104. Meanwhile, a negative pressure of a predetermined level is maintained on the ink by virtue of numerous minute ink meniscuses in the portion of the porous member 103 between the compartment which is closest to the discharge opening 105*a* among the compartments which have been emptied and the compartment which is adjacent to such compartment and which still contains ink.

A description will now be given of the behavior of the ink in the container when the ink jet recording apparatus is not operating. Since the ink is a liquid, its volume does not substantially change in response to change in the environmental conditions, for example, ambient air temperature and pressure. However, air in the container expands or contracts when the ambient air temperature and/or pressure is changed. In the state shown in FIG. 3(*a*), expansion of air in the first to third compartments does not cause any pressure change on the ink in the recording head, because the air is allowed to escape to the exterior via the porous member 103 and then through the vent hole 104. A problem, however, is caused by the air confined in the fourth compartment. Namely, expansion of the air in the fourth compartment, isolated from the vent hole 104 by the ink remaining in this compartment, builds up an elevated pressure inside the fourth compartment so as to force ink towards the third compartment through the porous member 103. The ink permeating into the porous member 103, however, tends to spread through the porous member 103 towards the first compartment. As a result, the air in the third and second compartments is isolated from the vent hole 104 by the ink impregnating the porous member. Consequently, most of the ink forced from the fourth compartment is received into the first compartment where the vent hole 104 opens, substantially without entering the third and second compartments, as shown in FIG. 3(*b*).

When the temperature of the ink container in the state shown in FIG. 3(*b*) is lowered, the masses of air confined in the second, third and fourth compartments and isolated from the vent hole 104 contract to cause the ink which has been accumulated in the first compartment to be sucked back into the second, third and fourth compartments, so that the initial state is recovered in the ink container as shown in FIG. 3(*c*).

The above-described behavior of the ink container, as performed when the ink jet recording apparatus is not operating, is achieved regardless of the posture of the ink container, except when the ink container is turned upside down from the state shown in FIG. 3(*a*) so that the portion of the porous member 103 inside the fourth compartment is not contacted by ink in this compartment. The behavior is somewhat different in that case. Namely, the reverse flow of ink into the first compartment is prevented because all of the air in the ink container is in communication with the vent hole.

In general, plastics are mainly used as the material of the kind described, due to excellent formability and low cost. However, plastics are microscopically porous and do not perfectly block gas molecules. Thus, the ink container wall actually functions as a semipermeable membrane which allows ambient dry air into the air in the ink container, which is saturated with water vapor from the ink. Consequently, the amount of air in the ink tank progressively increases as time elapses so as to forcibly move ink back into the first compartment (referred to also as a "buffer compartment"), having the vent hole 104. The air further permeates into the porous member 103 so as to break the continuity of the ink between adjacent compartments. In the worst case, the amount of air induced due to aspiration through the container wall is so large that ink is accumulated in the buffer compartment and spills from the vent hole.

Ink spilt from the ink container not only contaminates the interior of the recording apparatus but also can cause trouble such as jetting failure because ink is prematurely exhausted or the introduction of air voids in the ink when the printing is commenced, thus significantly degrading print quality.

On the other hand, recycling technology for enabling reuse of refuse is attracting attention due to the current demand for preservation of natural resources. This demand applies to many articles, including ink containers of ink jet recording apparatuses. It is therefore desirable that the ink containers are constructed to be reusable by recharging them with ink after exhaustion of the ink therein. Recharging of an ink container of the known type described would be possible in various ways. For instance, the ink container can be constructed to enable separation of the recording head 105 from the ink container 101 to enable recharging of the ink through a joint 101J, as shown in FIG. 4. If such separable construction cannot be adopted, it also would be possible to provide a charging port in the sixth compartment closest to the recording head 105 to enable recharging of the ink therethrough. It also would be possible to use the vent hole 104 as a recharging port.

FIG. 5 illustrates an example of the ink recharging method in which the ink container 101 is turned upside down and is recharged with ink through the joint 101J. This method, however, cannot be successfully carried out because, after the sixth compartment is fully charged, the ink flows to the first compartment where the vent hole 104 opens, without entering the fifth, fourth, third or second compartment. This is attributable to the following fact. Even after the ink in the ink container has been consumed, ink still remains in the porous member 103, without discontinuities from the sixth compartment to the first compartment. Therefore, the porous member 103 in effect functions as a pipe and retains ink due to surface tension, so that no ink is introduced into any of the compartments except the first compartment. The continuity of the ink in the porous member 103 is broken only in the first compartment, so that the surface tension is overcome in this compartment to allow the ink to enter this compartment. If the porous member 103 is renewed or dried before the recharging, it will not serve as a pipe, because in such a case the surface tension is too small to retain ink against the charging pressure. In such a case, it may be possible to refill the successive compartments of the ink container. Thus, the recharging method shown in FIG. 5 can refill only the sixth and first compartments when the porous member 103 is still wet, thus lessening the advantages of reusing the container. In other words, all of the compartments can be reliably refilled only when the porous member 103 is renewed or dried, and it is inconvenient that proper refilling depends on the state of the porous member.

SUMMARY OF THE INVENTION

Accordingly, an object of the present invention is to provide a liquid container such as an ink container which, even though it is made of plastic, substantially eliminates permeation of ambient air and which is preferably reusable, thereby coping with the aforesaid demands while obviating the shortcomings of the known art.

In accordance with one aspect of the present invention, a liquid container comprises a plurality of liquid compartments bounded by walls for holding liquid to be supplied external to the container through a supply port when the container is in a normal orientation, a communication port between adjacent the compartments and proximate to the bottom thereof when the container is in the normal orientation, and a buffer chamber having a common wall with the compartments at least proximate to the top thereof when the container is in the normal orientation.

In accordance with another aspect of the present invention, a liquid container comprises a plurality of liquid compartments for holding liquid to be supplied external to the container through a supply port, the compartments being formed by a plurality of partition walls separating adjacent the compartments, a communication port at each the partition wall for communicating adjacent the compartments, and a porous member in each the communication port, wherein the each of the compartments has a portion exposed to an opening in the porous member.

These and other objects, features and advantages of the invention will become clear from the following description of the preferred embodiments taken in conjunction with the accompanying drawings.

DESCRIPTION OF THE PREFERRED EMBODIMENTS

Preferred embodiments of the present invention will be described with reference to the accompanying drawings.

Figure 1:
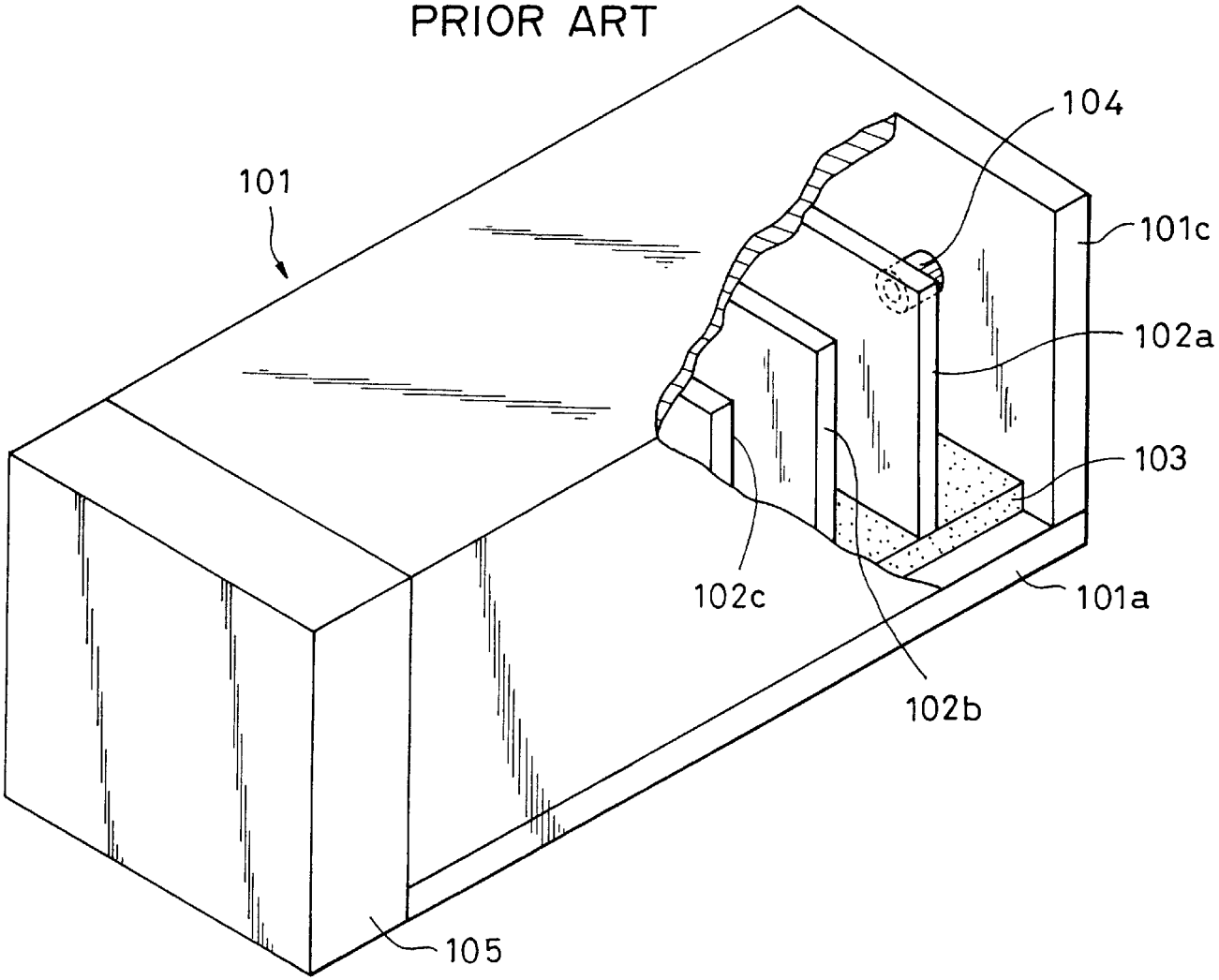
FIG. 1 PRIOR ART
FIG. 1 is a partially broken-away perspective view of a cartridge using a known liquid container.
Figure 2:
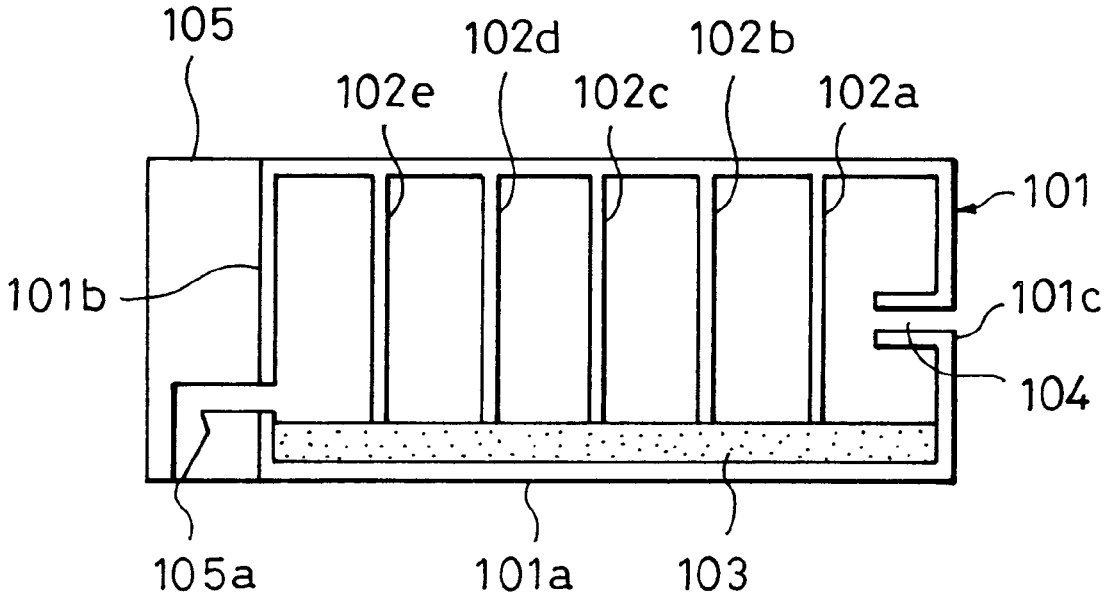
FIG. 2 PRIOR ART
FIG. 2 is a schematic sectional view of the cartridge shown in FIG. 1.
Figure 3A:
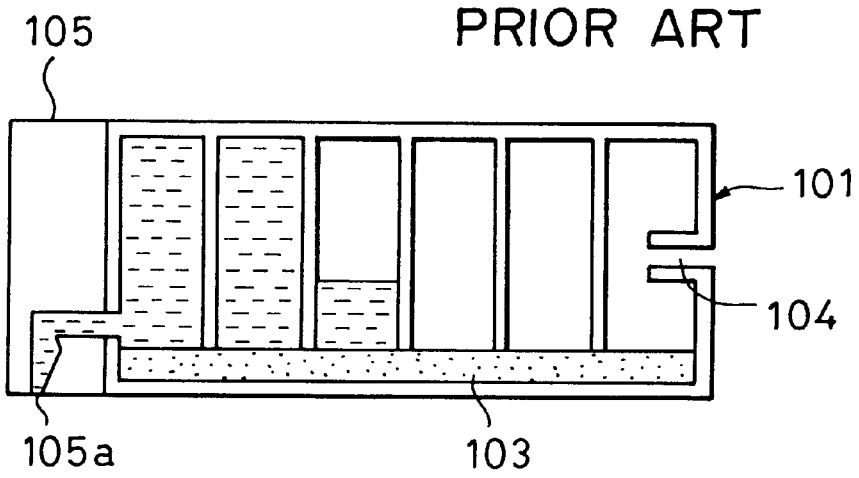
FIGS. 3(*a*) to 3(*c*) are illustrations of the behavior of the known cartridge in use on a recording apparatus during a recording operation.
Figure 3B:
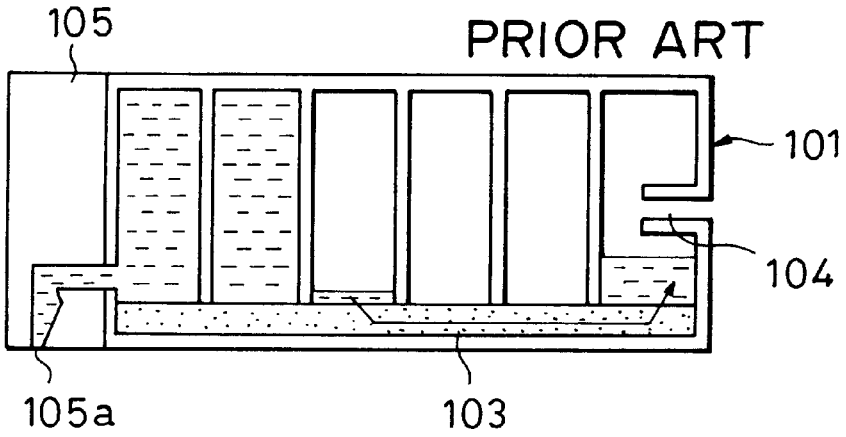
Figure 3C:
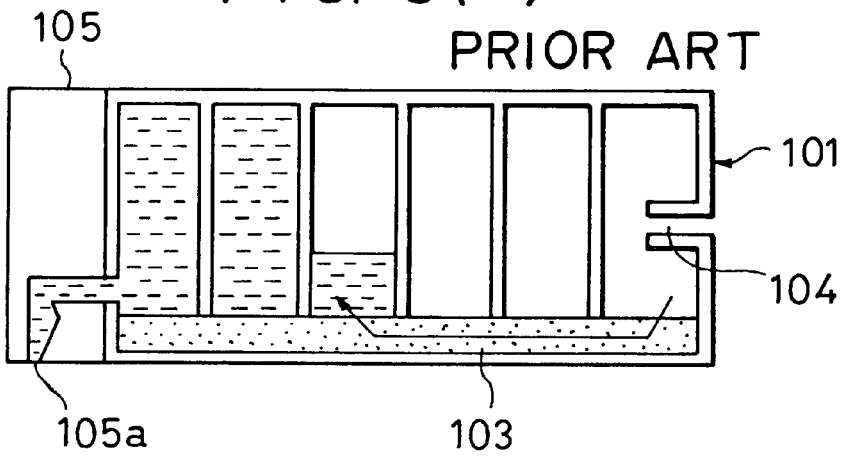
Figure 4:
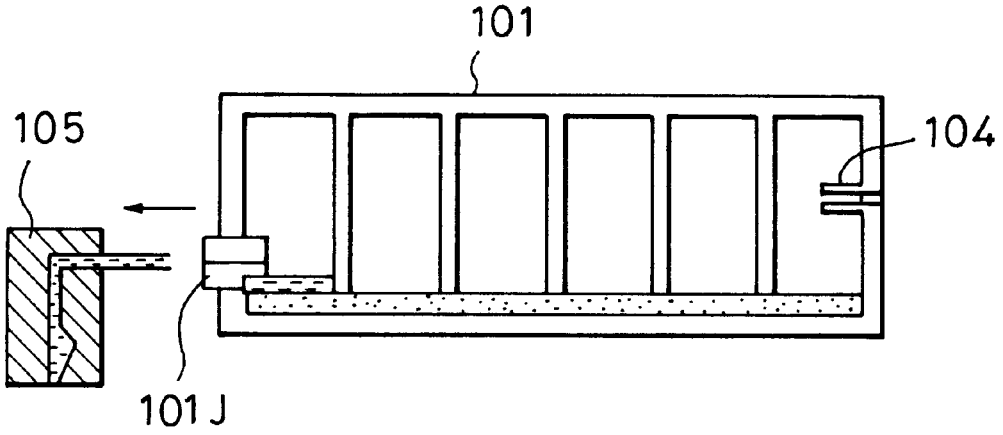
FIG. 4 PRIOR ART
FIG. 4 is a schematic illustration of a specific form of a known cartridge.
Figure 5:
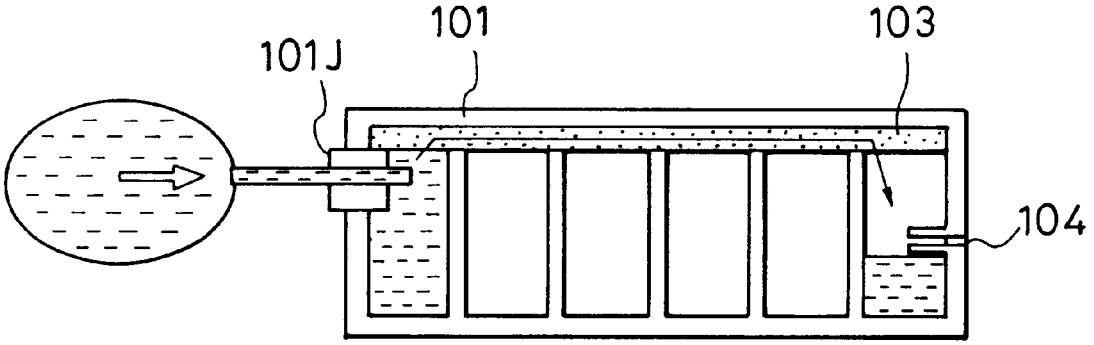
FIG. 5 PRIOR ART
FIG. 5 is an illustration of a method for refilling the known cartridge after consumption of the liquid therein.
Figure 6:
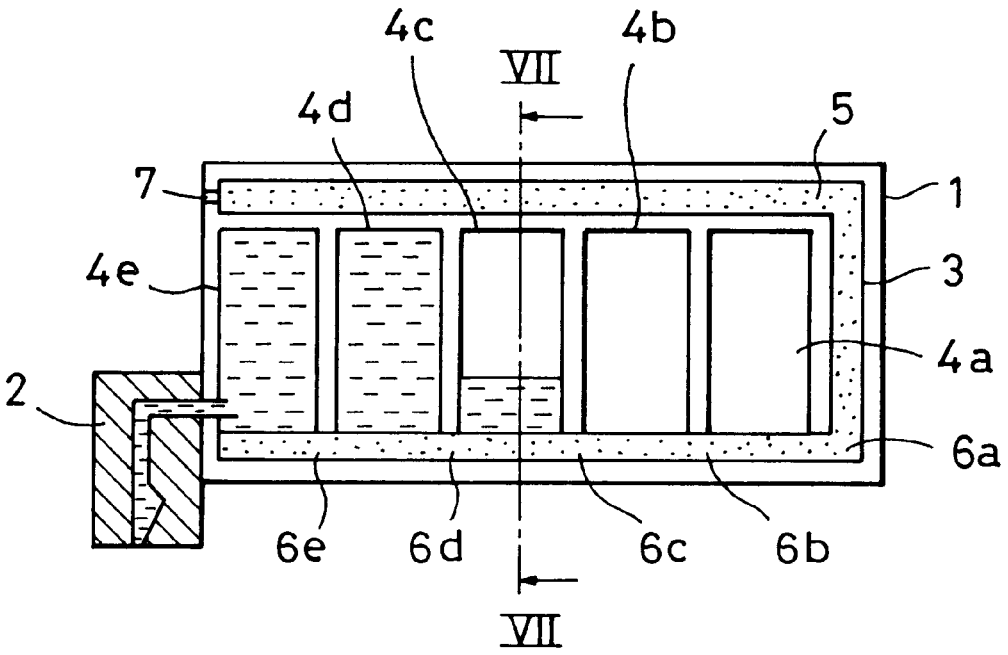
FIG. 6 is a schematic sectional view of an ink cartridge as an embodiment of the present invention.
Figure 7:
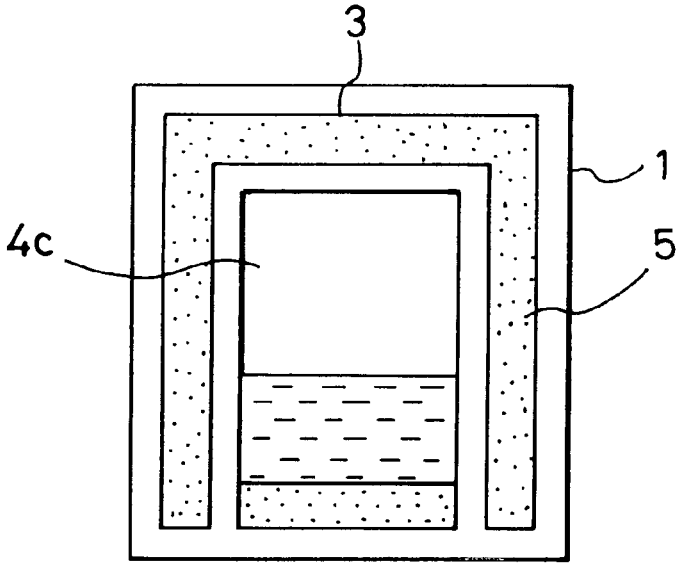
FIG. 7 is a sectional view of the ink cartridge of FIG. 6, taken along the line VII—VII of FIG. 6.

FIG. 6 is a schematic sectional view of an ink container as an embodiment of a liquid container in accordance with the present invention, taken along a plane parallel to the direction of an array of plural ink compartments defined in the container, while FIG. 7 is a sectional view taken along the line VII—VII of FIG. 1.

In these figures, the ink container is shown together with a recording head 2 which is connected to the ink container and which jets discrete droplets of ink onto a recording medium such as a sheet of paper. The recording head may be disconnectable from the ink container.

As shown in FIGS. 6 and 7, the ink container has a container body 1 which is similar in shape and function to that of the known ink container described before.

The ink container has a buffer compartment or chamber 3 and a plurality of ink compartments 4*a*, 4*b*, 4*c*, 4*d* and 4*e*. As in the case of a known ink container, the buffer container 3 has an internal volume substantially the same as that of each ink compartment. As will be seen from FIGS. 6 and 7, however, the buffer compartment 3 has such a configuration as to cover the top and side walls of the ink compartments when the container is in its depicted normal orientation. In the illustrated embodiment, the buffer compartment is charged with a porous member 5. The buffer compartment 3 communicates with the first ink compartment 4*a* through a communication opening 6*a* and also with the ambient air through a vent hole 7. Adjacent compartments communicate through respective openings 6*b*, 6*c*, 6*d* and 6*e*. According to this arrangement, the ink compartments 4*a* to 4*e* are covered by the buffer chamber 3 without making direct contact with the ambient air, so that permeation of the ambient air into the containers, which inevitably takes place in the known ink container, can be avoided.

Figure 8A:
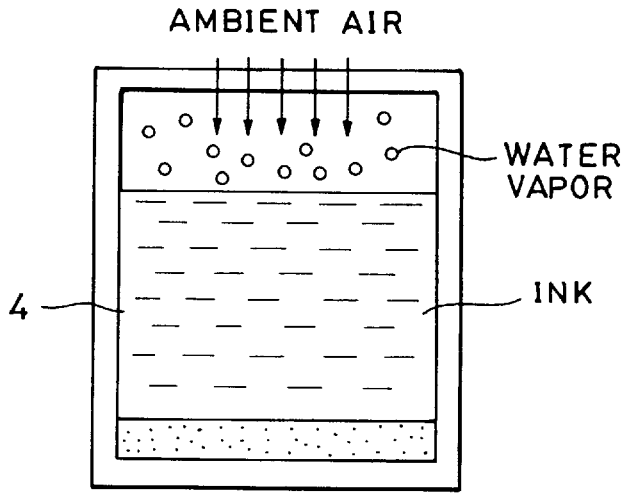
FIG. 8(a) PRIOR ART
FIGS. 8(*a*) to 8(*c*) are illustrations of the manner in which ambient air can be introduced into various ink cartridges.
Figure 8B:
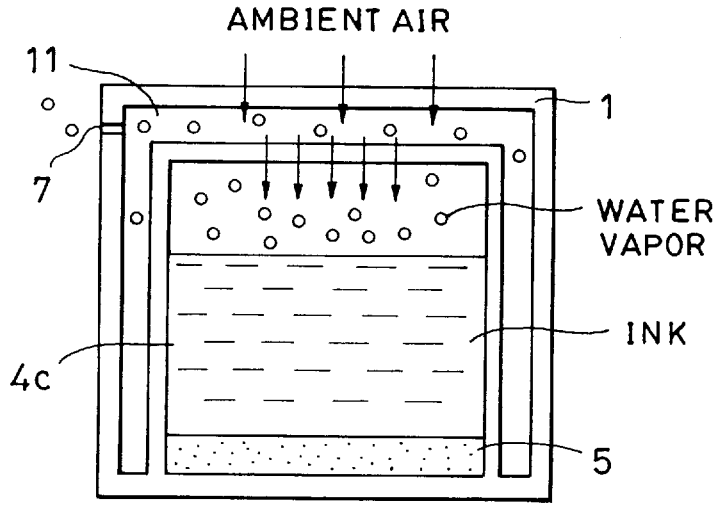
Figure 8C:
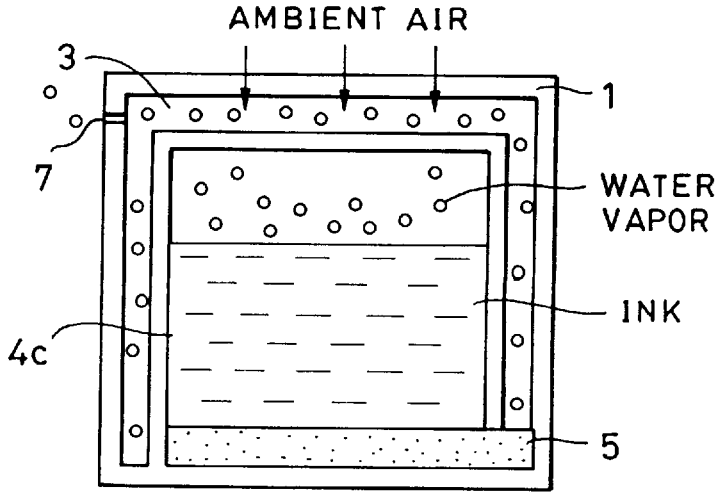

The operation of this ink container will be described with reference to FIGS. 8(*a*) to 8(*c*). FIG. 8(*a*) shows a conventional arrangement in which the walls of the ink compartments are directly exposed to the ambient air, without being covered. The air confined in an ink compartment 4 in which the ink has been partly consumed can be regarded as being saturated with water vapor. When the condition shown in FIG. 8(*a*) is maintained for a long time, the ambient air tends to permeate into the ink compartment 4 so as to dilute the water vapor in the air. However, evaporation of the ink continues as long as the ink exists in this compartment 4 and so does the permeation of the ambient air, seeking to attain and maintain an equilibrium state between the air inside the compartment 4 and the ambient air across the walls of the ink compartment 4. Consequently, the volume of air in the ink compartment increases and pressurizes the ink inside the ink compartment 4 to force it out of the ink compartment. This may lead to ink spilling out of the ink container as explained before.

FIG. 8(*b*) shows an arrangement in accordance with the present invention, in which an intermediate buffer compartment 11 is provided between the ink compartment 4*c* and the ambient air. This buffer compartment 11 communicates with the ambient air through a small hole 7 and surrounds on three sides but does not communicate with the ink compartment 4. In this case, permeation of air takes place from the intermediate compartment 11 and the ink compartment 4*c* across the walls of the ink compartment 4*c*, so as to nullify the difference in the humidity between the interior of the ink compartment 4*c* and the interior of the intermediate compartment 11. At the same time, water vapor moves from the ink compartment 4*c* into the intermediate compartment 11. The movement of the air and the water vapor terminate when equilibrium of humidity is established between the intermediate compartment 11 and the ink compartment 4*c*. The intermediate compartment 11 communicates with the ambient air only through a small hole 7, so that movement of air and/or moisture from the exterior of the container and the intermediate compartment 11 and vice versa takes place only at a small rate. Nevertheless, the volume of air in the ink compartment 4*c* steadily increases because air progressively enters the ink compartment 4*c* due to the difference in the humidity between the intermediate compartment 11 and the ink compartment 4*c*, although the rate of increase in the air volume in the ink compartment 4' is smaller than the case of the arrangement shown in FIG. 8(*a*). Consequently, the arrangement shown in FIG. 8(*b*) still presents a slight risk of ink spilling out of the container.

FIG. 8(*c*) shows a still more effective arrangement in accordance with the present invention, in which the ink compartment 4*c* is covered and surrounded by the buffer compartment 3, which directly communicates with the ink compartment 4*c* through the porous member 5. In this case, the vapor phase evaporated from the ink compartment directly flows into the buffer compartment 3, so that the air inside the buffer compartment 3 is held in a condition almost saturated with the water vapor. In other words, the ink compartment in which the ink has been partly or completely consumed is regarded as effectively being part of the buffer compartment 3. Accordingly, there is no substantial difference in the humidity in the ink compartment 4*c* and the buffer compartment 3, so that substantially no permeation of air takes place from the buffer compartment 3 into the ink compartment 4*c* through the walls of the ink compartment 4*c*. Consequently, there is no substantial increase in the air volume inside the ink compartment 4*c*, thus preventing ink from being forced out of this compartment by an increase in the air volume. Although the buffer compartment 3 communicates with the ambient air through the small vent hole 7, the rates of emission of water vapor from the buffer compartment 3 to the exterior and introduction of ambient air into the buffer compartment 3 through the hole 7 are very small as compared with the rates of emission of the water vapor from the ink compartment 4*c* into the buffer compartment 3 and introduction of air into the ink compartment 4*c*, so that the humidity in the buffer compartment 3 is maintained substantially constant.

As will be understood from the foregoing description, in the ink container of this embodiment, the ink compartments share a common all with the buffer compartments, and in this embodiment are covered and surrounded by the buffer compartment on three sides of the container, which maintains an atmosphere of the same humidity as the ink compartment, so that the permeation of air into the ink compartments through the walls thereof is remarkably suppressed. This avoids a substantial increase in the volume of the air in the ink compartments, thus preventing ink from being forced out of the ink compartment and the consequent spilling of ink from the ink container.

Although the buffer compartment 3 in the above embodiment is so constructed as to cover the top wall and both side walls of the ink compartment, this is not essential and the arrangement may be such that only the top wall or one or both of the side walls of the ink compartments is covered by the buffer compartment 3. Thus, the above-described advantages of the present invention are obtainable when at least one wall of the ink compartments shares a common wall with the buffer compartment.

The present invention is also advantageous because air can sometimes be trapped in the container during charging of the ink. Such trapped air tends to stagnate in the ink compartment, even though ink has not been consumed therefrom, forming an air layer at the top, and therefore contacting the top wall, of the ink compartment. Such stagnant air is saturated with water vapor, so that ambient air would tend to permeate into this ink compartment through the top wall in contact with the layer of the stagnant air. The rate of permeation of air into the ink compartment through the top wall will increase in proportion to the volume of the air in the ink compartment, so the rate of air introduction and, hence, the rate of increase in the air volume, are accelerated as time elapses. In view of this problem, it is advisable and preferred to cover at least the top wall of the ink compartment so as to effectively prevent permeation of air into the ink compartment before the ink container is placed in use or in the initial period of use of the same.

As a modification, the ink container of this embodiment may be realized by using the arrangement shown in FIG. 8(*b*), with the intermediate compartment 11 being filled with a porous member impregnated with water or liquid ink to such an extent that the water or liquid does not exude from the vent hole. In such a modification, the difference in the humidity between the adjoining ink compartment and the intermediate compartment is small since the latter is filled with water or liquid ink, so that permeation of air into the ink compartment through the walls of the ink compartment is remarkably suppressed. Furthermore, this modification is simple in construction and is easy to fabricate because it is not necessary to form a communication hole between the intermediate buffer compartment and the ink compartments. In this case, however, it is necessary to provide a vent hole in the ink compartment which is most remote from the ink discharge opening.

Thus, in the first embodiment and its modification described hereinbefore, any unintentional increase in the air volume inside an ink compartment is suppressed by virtue of the fact that at least part of the wall of the ink compartment is covered by the buffer compartment, thus eliminating forcing of ink out of this compartment and the consequent spilling of ink from the container.

Figure 9:
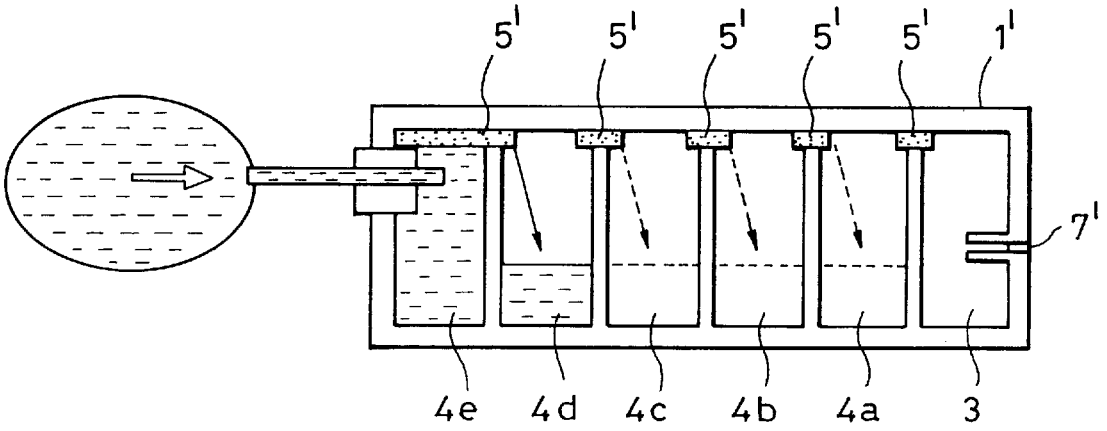
FIG. 9 is an illustration of a method for refilling the ink container according to the present invention.

FIG. 9 shows another embodiment of the present invention, which facilitates refilling of the container with ink. The ink container shown in FIG. 9 is similar to that shown in FIG. 6 but is different therefrom in that the porous member 5 which is laid over the entire area of the bottom surface of the ink container in FIG. 6 is divided into discrete segments 5' which are provided only in the regions where the partition walls defining adjacent compartments are provided. These discrete segments provide openings in the previously described porous member 5, so that each compartment has at least a portion exposed to an opening in the porous member at which openings introduced into the compartment (see arrows in FIG. 9).

The ink container having discrete segments of the porous member, when it is to be refilled with the ink, is turned upside down. Ink, charged from the joint that becomes accessible after separation of the recording head, fills the ink compartment 4*e* first. After this ink compartment is filled with ink, the ink is introduced into the next ink compartment 4*d* through the opening defined by the porous member segment 5' provided between these two ink compartment 4*d*, 4*e*. As the ink is further charged, the ink further impregnates the porous member segment 5' between the ink compartments 4*d* and 4*c* and then floods into the ink compartment 4*c*. A further supply of the ink causes successive ink compartments to be filled with ink and finally the ink container is refilled with the ink to the ink compartment 4*a*.

The structure in FIG. 9 is rather difficult to assemble because the porous member segments 5' must be positioned only in the regions where the partition plates are provided.

A description will now be given of a method which enables easy positioning of porous member segments shown in FIG. 9.

Figure 10:
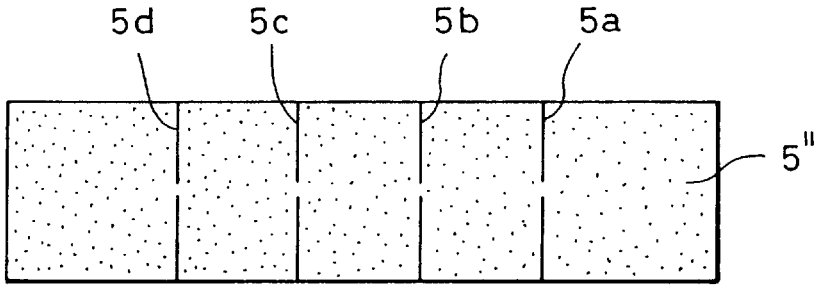
FIG. 10 is an illustration of an example of a porous member suitable for use in an easily refilled ink cartridge according to the present invention.

FIG. 10 shows an example of the porous member 5' suitably used in this embodiment of the present invention. The porous member 5", made of a material such as sponge, has outer dimensions which are the same as those of the porous member used in known ink containers. The porous member 5", however, is provided with slits 5*a* to 5*d* at the portions to be located in the middle of the ink compartments (except for the portions to be located in the ink compartments closest to and most remote from the recording head).

Figure 11:
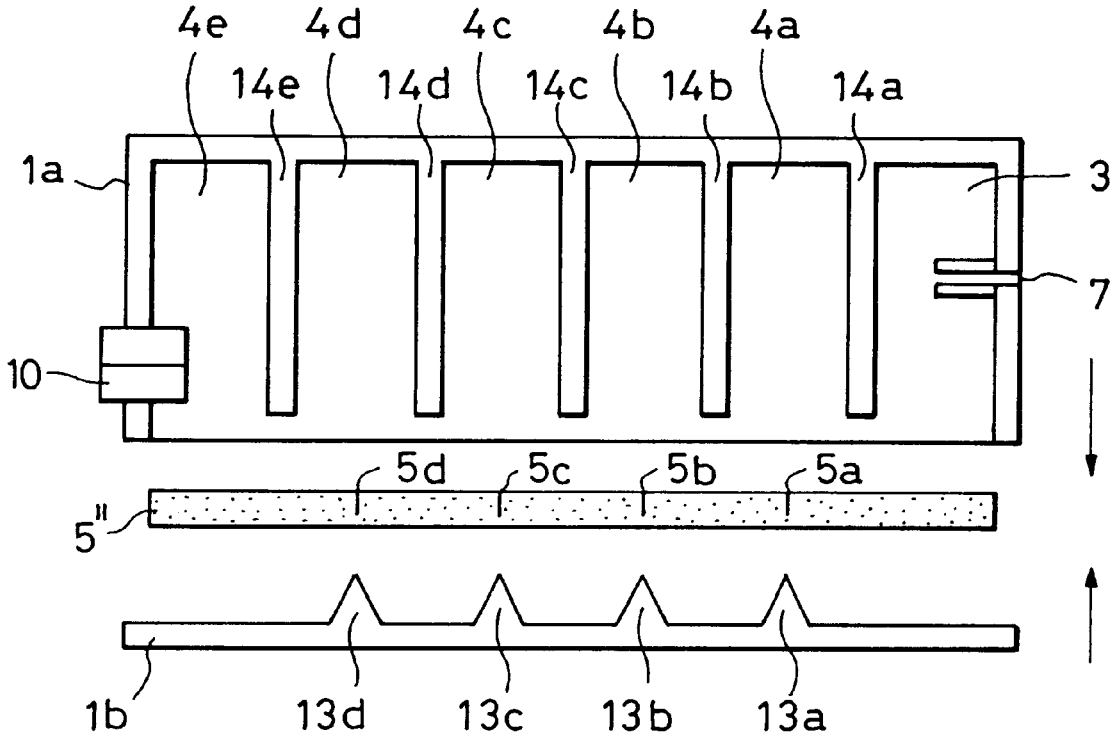
FIG. 11 is an illustration of an example of an ink container construction using the porous member shown in FIG. 10.

FIG. 11 shows an ink container using the porous member 5" being assembled. The ink container has, as illustrated, a container upper structure 1*a* and a container bottom plate 1*b* which are to be assembled together with the porous member 5" placed therebetween. The container upper structure 1*a* has partition plates 14*a*, 14*b*, 14*c*, 14*d* and 14*e* which define, in cooperation with the porous member 5" backed up by the container bottom plate 1*b*, a plurality of ink compartments 4*a*, 4*b*, 4*c*, 4*d* and 4*e*. A rubber plug 10 for covering a joint, provided for attachment to a recording head (not shown), in a wall of the ink compartment 4*e*. A compartment 3 serves for preventing ink leakage. The compartment 3 has a vent hole 7 which provides communication between this compartment and the ambient air. The container bottom plate 1*b* is provided with ribs 13*a*, 13*b*, 13*c*, and 13*d* which protrude, in a triangular form as illustrated, from the upper face of the container bottom plate 1*b* at positions to be located in the middle of the respective ink compartments 4*a*, 4*b*, 4*c* and 4*d*.

Figure 12:
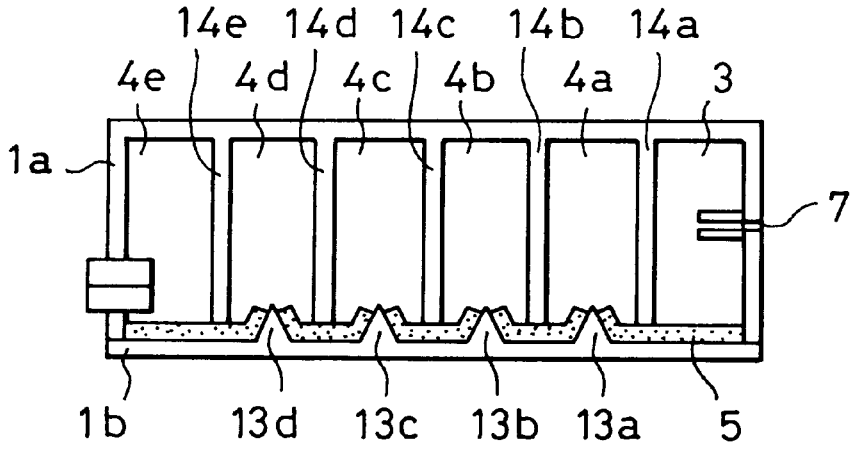
FIG. 12 is a schematic sectional view of an assembled ink container with the construction shown in FIG. 11.

FIG. 12 illustrates the ink container after assembly. When the container bottom plate 1*b* is moved closer to the container upper structure 1*a*, the triangular ribs 13*a* to 13*d* enter the spaces between the adjacent partition plates 14*a* to 14*e*, so that the porous member 5" is torn along the slits 5*a* to 5*d*, thus forming openings that provide discrete segments of the porous member 5". These segments, after the assembly of the container, are separated by the ribs 13*a* to 13*d* so as not to contact each other.

Thus, the ink container shown in FIG. 12 has porous material only in the regions where the partition plates exist, and openings in the compartments, thus realizing a construction equivalent to that shown in FIG. 9.

Therefore, this ink container, after the initially charged ink has been consumed, can be refilled in the same manner as that described before, through an opening which becomes accessible after removal of the rubber plug 10.

Figure 13:
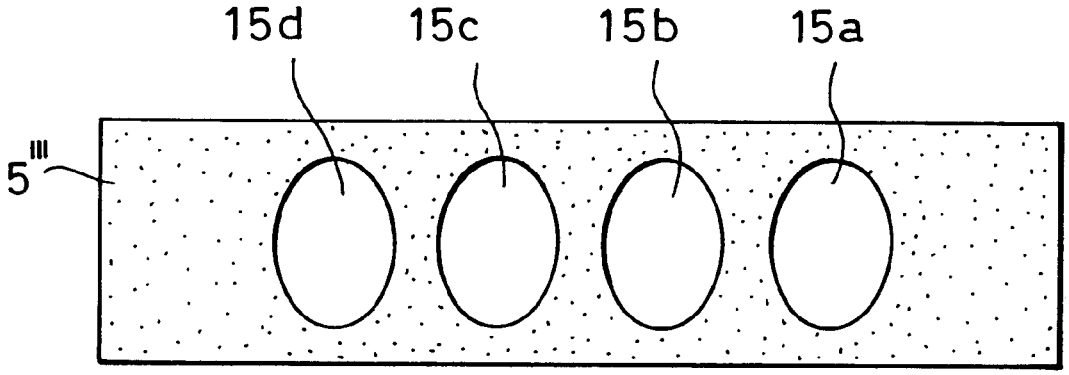
FIG. 13 is an illustration of another example of a porous member suitable for use in a refillable ink cartridge.

FIG. 13 shows another example of a porous member 5"' suitable for use in the present invention. This porous member has outer dimensions the same as those of the porous members used in the known ink containers, but is distinguished therefrom in that oval apertures 15*a*, 15*b*, 15*c* and 15*d* are formed therein so as to be located at the positions substantially in the middle of each ink compartment (except for those closest to and most remote from the recording head). The porous material, however, is present at both longitudinal side marginal portions of the porous member even in the regions where the oval apertures 15*a* to 15*d* are formed.

Figure 14:
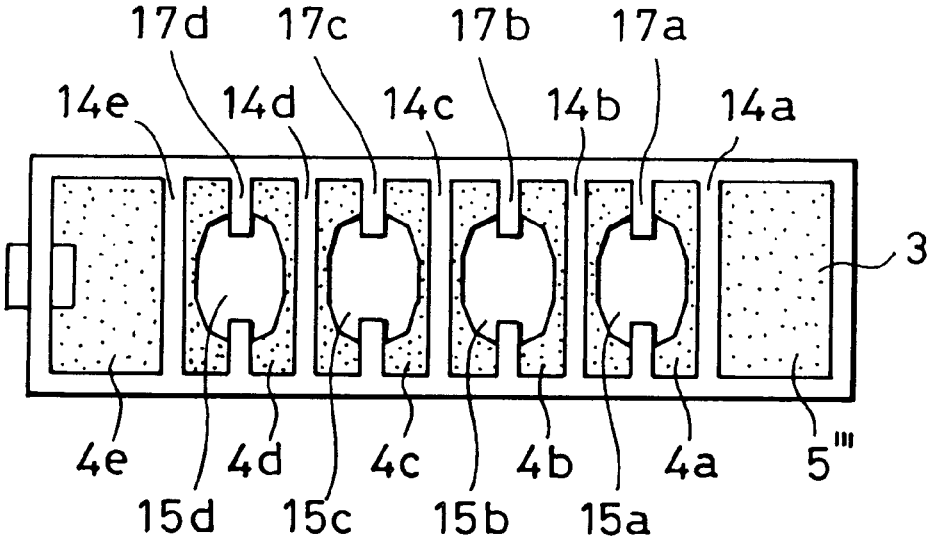
FIG. 14 is an illustration of an ink container incorporating the porous member shown in FIG. 13.

FIG. 14 is a sectional top plan view of an ink container incorporating the porous member shown in FIG. 13. In this case also, the ink container is composed of a container upper structure and a container bottom plate which are assembled together with the porous member 5"' placed therebetween. The container upper structure 1*a* has five partition plates 14*a* to 14*e* which define, in cooperation with the walls of the upper structure 1*a*, five compartments 4*a* to 4*e* and the chamber 3. The compartments 4*a* to 4*d* serve as ink compartments. The ink compartment 4*e*, which is closest to the recording head (not shown) is provided with a rubber plug for covering a joint provided for connection to the recording head. The ink compartments 4*a* to 4*d* are respectively provided at their mid-portions with pairs of ribs 17*a*, 17*b*, 17*c* and 17*d*. In each ink compartment, the pair of ribs extend toward each other from opposite side walls of the container upper structure, in parallel with the partition plates 14*a* to 14*d*. The ribs 17*a* to 17*d* extend downward to a level which is slightly below that of the partition plates 14*a* to 14*e*. In addition, the space between the opposing ribs of each pair is smaller than the length of the longer axis of the apertures 15*a* to 15*d*.

In the assembled state of the ink container, the portions of the porous member 5"' which are at both sides of the apertures 15*a* to 15*d* are pressed and compacted by the ribs 17*a* to 17*d*. Such compacted portions of the porous member 5"' do not function as a porous material, so that an effect is produced which is materially equivalent to the segmentation of the porous member 5"' into discrete segments accommodated in the respective ink compartments.

Thus, the present invention provides a liquid container in which liquid evaporation is suppressed (see FIGS. 6–8) and which can be easily and reliably refilled (see FIGS. 9–14). Those skilled in the art will recognize that the invention also encompasses a liquid container incorporating both these aspects of the invention.

What is claimed is:

1. A liquid container comprising:

a container body having an outer wall and an inner wall;

more than two liquid compartments bounded by walls for holding liquid to be supplied external to said container through a supply port when said container is in a normal orientation;

a communication port between adjacent said compartments and proximate to the bottom thereof when said container is in the normal orientation; and a buffer chamber having a common wall with said compartments at least proximate to the top thereof when said container is in the normal orientation, said buffer chamber being formed between said outer wall and said inner wall, wherein each of said compartments is separated from an adjacent one of said compartments by a partition wall having said communication port therein, said compartments are connected together in an array for liquid flow from each of said compartments successively into an adjacent one of said compartments until reaching a last one of said compartments having said supply port therein, each said partition wall is secured at three sides to said inner wall to provide said buffer chamber partially around three sides of each of said compartments, and each said communication port between adjacent said compartments is formed by a space between a fourth side of each said partition wall and said outer wall;

wherein said buffer chamber communicates with a first one of said compartments in said array thereof.

2. A liquid container according to claim 1, wherein said buffer chamber is substantially filled with a porous member and includes a vent opening for communicating said buffer chamber with the atmosphere.

3. A liquid container according to claim 2, wherein said vent opening is proximate to said last one of said compartments in said array thereof.

4. A liquid container according to claim 1, wherein said space between said fourth side of each said partition wall and said outer wall is occupied by a porous member.

5. A liquid container according to claim 4, wherein said porous member substantially covers an inside surface of said outer wall within each of said compartments.

6. A liquid container according to claim 5, wherein said porous member extends into said buffer chamber.

7. A liquid container according to claim 1, further comprising means for mounting an ink jet recording head for accepting liquid from said supply port.

8. A liquid container comprising:

more than three liquid compartments for holding liquid to be supplied external to said container through a supply port, said compartments being formed by a plurality of partition walls separating adjacent said compartments, each of said compartments being separated from an adjacent one of said compartments by one of said partition walls, wherein said compartments are connected together in an array for liquid flow from each of said compartments until reaching a last one of said compartments having said supply port therein;

a plurality of communication ports, each of said communication ports being disposed at one of said partition walls for communicating adjacent said compartments;

a container body having an outer wall and an inner wall forming therebetween a buffer chamber, wherein each said partition wall is secured at three sides to said inner wall to provide said buffer chamber around three sides of each of said compartments and wherein each said communication port between adjacent said compartments is formed by a space between a fourth side of each said partition wall and said outer wall; and a plurality of porous members, each of said members being disposed in one of said communication ports;

wherein said buffer chamber includes a vent opening for communicating said buffer chamber with the atmosphere, said buffer chamber communicating with a first one of said compartments in said array thereof and said vent opening being proximate to said last one of said compartments in said array thereof.

9. A liquid container comprising:

more than two liquid compartments for holding liquid to be supplied external to said container through a supply port, said compartments being formed by a plurality of partition walls separating adjacent said compartments;

a plurality of communication ports, each of said communication ports being disposed at one of said partition walls for communicating adjacent said compartments;

a container body, wherein each of said partition walls is secured to walls of said container body, and each of said communication ports is formed between a wall of said container body and one of said partition walls;

a continuous porous member having a plurality of apertures transverse therethrough and a plurality of compressible portions for retarding fluid flow through said porous member, each of said apertures being disposed in and communicating with a respective one of said compartments; and at least one pressing member in each of said compartments for compressing a corresponding compressible portion of said porous member and thereby retarding fluid flow through said porous member between said communication ports.

10. A liquid container according to claim 9, wherein said continuous porous member has openings along a center thereof and each of said pressing members includes two pressing portions at two sides of each of said openings.

* * * * *

UNITED STATES PATENT AND TRADEMARK OFFICE

CERTIFICATE OF CORRECTION

PATENT NO. : 5,971,530

DATED : October 26, 1999

INVENTORS : Kenichiro Hashimoto

It is certified that error appears in the above-identified patent and that said Letters Patent is hereby corrected as shown below:

On the Cover Page

Under References Cited, U.S. Patent Documents, change "Nakajimo" to --Nakajima--; and In the abstract, line 13, delete "a".

Column 1

Line 14, change "suppressES" to --suppresses--.

Column 7

Line 10, change "all" to --wall--.

COLUMN 8

Line 39, change "5′" to --5--.

Signed and Sealed this

Fifth Day of December, 2000

*Attest:*

*Attesting Officer*

Q. TODD DICKINSON

*Director of Patents and Trademarks*